US012698131B1

(12) United States Patent
Kelly

(10) Patent No.: US 12,698,131 B1
(45) Date of Patent: Aug. 4, 2026

(54) CONTAINER AND STAND SYSTEM

(71) Applicant: James Kelly, Albany, NY (US)

(72) Inventor: James Kelly, Albany, NY (US)

( * ) Notice: Subject to any disclaimer, the term of this patent is extended or adjusted under 35 U.S.C. 154(b) by 0 days.

(21) Appl. No.: 18/474,077

(22) Filed: Sep. 25, 2023

Related U.S. Application Data

(60) Provisional application No. 63/409,954, filed on Sep. 26, 2022.

(51) Int. Cl.
*B65D 25/24* (2006.01)

(52) U.S. Cl.
CPC ..... *B65D 25/24* (2013.01)

(58) Field of Classification Search
CPC .... B65D 21/04; B65D 21/048; B65D 21/043; B65D 21/045; B65D 21/046; B65D 21/0234
USPC ..... 206/514
See application file for complete search history.

(56) References Cited

U.S. PATENT DOCUMENTS

2006/0180491 A1* 8/2006 Zephir ..... B65D 21/046 206/507
2020/0206968 A1* 7/2020 Seed ..... B27L 7/08

* cited by examiner

*Primary Examiner* — Jeffrey R Allen
(74) *Attorney, Agent, or Firm* — QuickPatents; Kevin Prince

(57) ABSTRACT

A container system for use on a horizontal surface, such as a floor, includes a container that has a bottom, at least one peripheral side, and an open top end. The at least one peripheral side projects upwardly from a perimeter of the bottom and terminates at a top edge. A stand has a top, at least one peripheral side, and an open bottom end. The at least one peripheral side projects downwardly from a perimeter of the top and terminates at a bottom edge. The open bottom end of the stand, when the stand is inverted, receives the bottom and the at least one peripheral side of the container therein in a nested configuration. The top of the stand is adapted to receive therein the bottom of the container in a stacked configuration.

15 Claims, 6 Drawing Sheets

CONTAINER AND STAND SYSTEM

CROSS REFERENCE TO RELATED APPLICATIONS

This application claims the benefit of U.S. Provisional Patent Application 63/409,954, filed on Sep. 26, 2022, and incorporated herein by reference.

STATEMENT REGARDING FEDERALLY SPONSORED RESEARCH AND DEVELOPMENT

Not Applicable.

FIELD OF THE INVENTION

This invention relates to containers, and more particularly to a container and support stand system.

BACKGROUND

Laundry basket, buckets, and other open top containers are often used in different applications that have differing optimal heights. For example, when pulling laundry out of a clothes dryer, a laundry basket resting on the ground in front of the clothes dryer is typically at an optimal height, as the laundry can be quickly pulled out of the clothes dryer and dropped into the laundry basket without having to raise the laundry up over a rim of the laundry basket. But when loading a top-loading washing machine, if the laundry basket is resting on the floor surface proximate the washing machine, the person typically must bend down each time to grab a handful of laundry and then raise up again to drop the laundry into the washing machine. Other applications, such as folding laundry on a countertop, also would be easier if the laundry basket was raised up. But putting the laundry basket on the countertop results in the person having to awkwardly reach up and over the rim of the laundry basket.

Other applications for open top containers would benefit from the container being easily positionable at two different heights. For example, beverages or food can be stored in a bin on a ground surface or on a shelf, but when used at a picnic or other gathering, such a bin if elevated would allow people to more easily access the contents of the bins without having to stoop down. Further, when the ground surface is unsanitary, it would be beneficial to isolate the areas of the bin or container that contact the ground surface to keep other areas of the bin and surrounding environment as clean as possible.

Therefore, there is a need for a container system that provides a built-in stand. Such a needed system would help isolate portions of the stand that contact the ground surface when the stand is not in use. In a collapsed position, such a needed system would take very little extra space to store or transport. The present invention accomplishes these objectives.

SUMMARY OF THE INVENTION

The present device is a container system for use on a horizontal surface, such as a floor or ground surface. The container system includes a container that has a bottom, at least one peripheral side, and an open top end. The bottom includes a perimeter, a top surface, and a bottom surface. The at least one peripheral side projects upwardly from the perimeter of the bottom and terminates at a top edge. The container can take the form of a basket, bin, barrel, bucket, can, pail, canister, or the like.

A stand has a top, at least one peripheral side, and an open bottom end. The top has a perimeter, a top surface, and a bottom surface. The at least one peripheral side projects downwardly from the perimeter of the top and terminates at a bottom edge.

The open bottom end of the stand, when the stand is inverted, is adapted to receive the bottom and the at least one peripheral side of the container therein such that the container and the stand are configured in a nested configuration. Further, the top of the stand is adapted to receive therein the bottom of the container such that the container and the stand are configured in a stacked configuration.

In some embodiments, the top surface of the top of the stand includes a raised lip at the perimeter thereof, adapted to receive the bottom of the container. As such, the container is inhibited from sliding off of the top of the stand when the container and stand are in the stacked configuration.

In preferred embodiments, the open top end of the container includes a curled lip configured for covering at least a portion of the bottom edge of the stand when the container and the stand are in the nested configuration. Preferably the bottom edge of the stand includes an outwardly projecting lip.

In some embodiments, the bottom edge of the stand includes a plurality of feet adapted to contact the horizontal surface when the stand and the container are in the stacked configuration with the stand resting on the horizontal surface. The top edge of the container is configured for substantially encompassing at least the plurality of feet of the stand when the container and the stand are in the nested configuration.

In some embodiments, the container and the stand are both substantially cylindrical in shape, the at least one peripheral side of the container being exactly one peripheral side, and the at least one peripheral side of the stand being exactly one peripheral side. In such an embedment, the container includes at least one handle fixed with the at least one peripheral side of the container. The at least one handle is configured for carrying the container by the handle. As such, the bottom edge of the stand includes a plurality of handle recesses each for receiving the at least one at least one handle therein when the container and the stand are in the nested configuration. In some embodiments, the container and the stand are both substantially oval or kidney bean shaped in plan view.

In such cylindrical embodiments, the container includes at least one handle fixed with the at least one peripheral side of the container. The at least one handle is configured for carrying the container by the at least one handle, and wherein the bottom edge of the stand includes a plurality of handle recesses for receiving the at least one at least one handle therein when the container and the stand are in the nested configuration.

Alternately, the container and the stand may both be substantially rectangular or square in shape. As such, the at least one peripheral side of the container is exactly four peripheral sides, and the at least one peripheral side of the stand is exactly four peripheral sides. In the embodiment wherein the container and the stand are substantially square in shape in plan view, the container is insertable into the stand at any angle evenly divisible by 90-degrees, making it more convenient to use in some situations.

In such an embodiment, the four peripheral sides of both the container and the stand may further include a plurality of apertures and four rounded and thickened corners, reinforced to support a greater weight in the container when the container and the stand are in the nested configuration. Alternately, the four peripheral sides of the container may be solid but for a plurality of handle apertures therethrough, such that the container can operate as a bucket and hold liquid, for example. Further, a top cover may be included to cover the open top end of the container in such an embodiment.

In some embodiments, the container has a height substantially the same as a height of the stand. In alternate embodiments the height of the container is less than the height of the stand. Further, the container may be tapered from the open top end to the bottom, with the stand also being cooperatively tapered from the open bottom end to the top. The shape of the container in plan view may be different at the open top end than at the bottom. For example, the shape of the container in plan view at the open top end may be square while at the bottom it may be circular.

The present invention is a bin or container system that provides a built-in stand. The present device provides for isolating portions of the stand that contact the ground surface when the stand is not in use. In a collapsed position, the present invention requires very little extra space to store or transport. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1B:
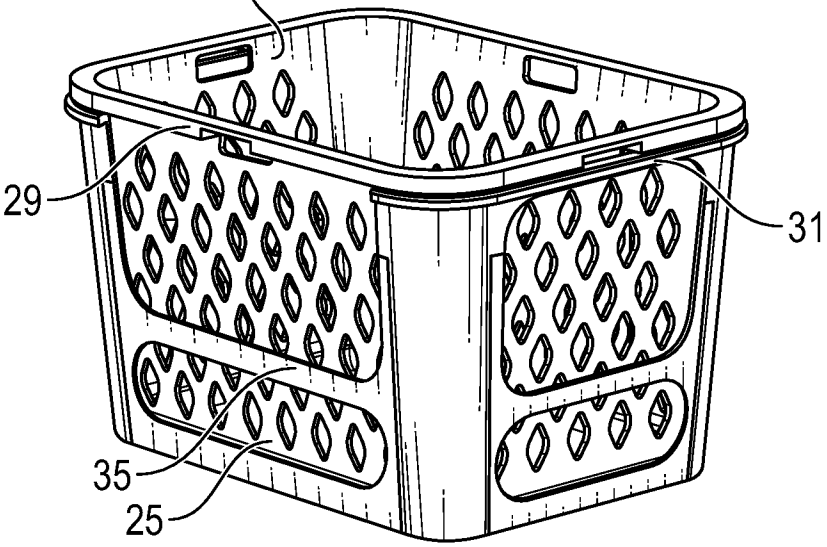
FIG. 1B is a perspective view of the invention, illustrating the container and the stand in a nested configuration.
Figure 1A:
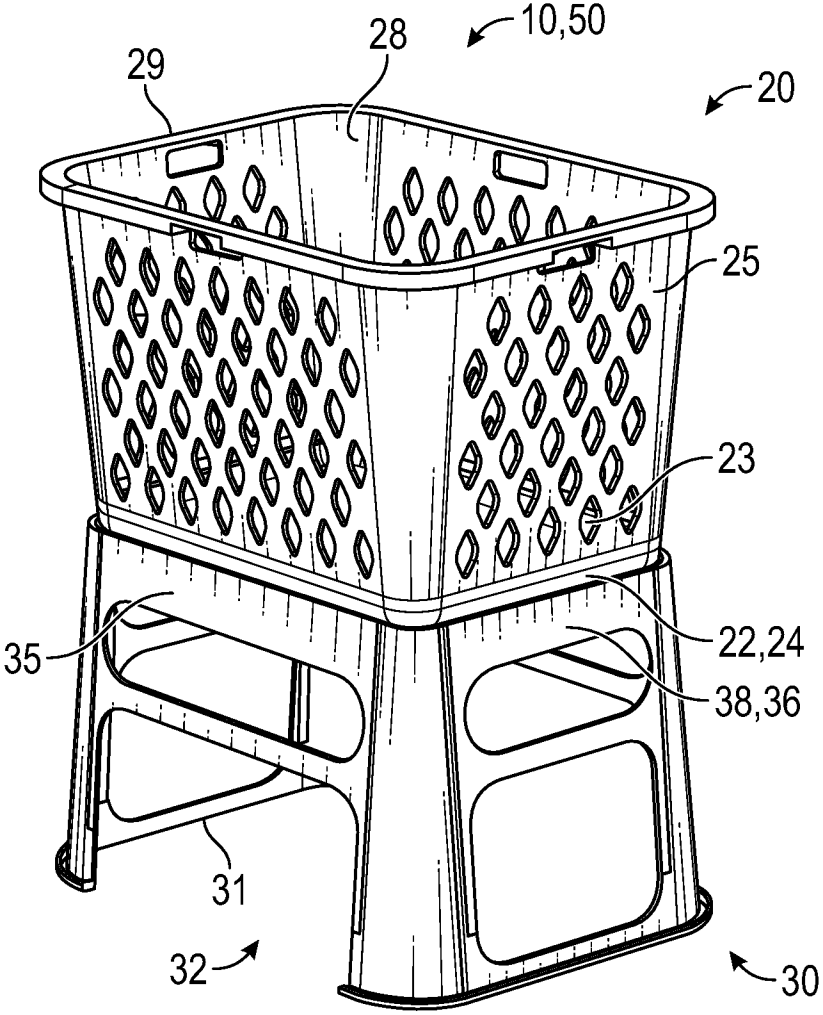
FIG. 1A is a perspective view of the invention, illustrating a container and a stand in a stacked configuration.
Figure 2A:
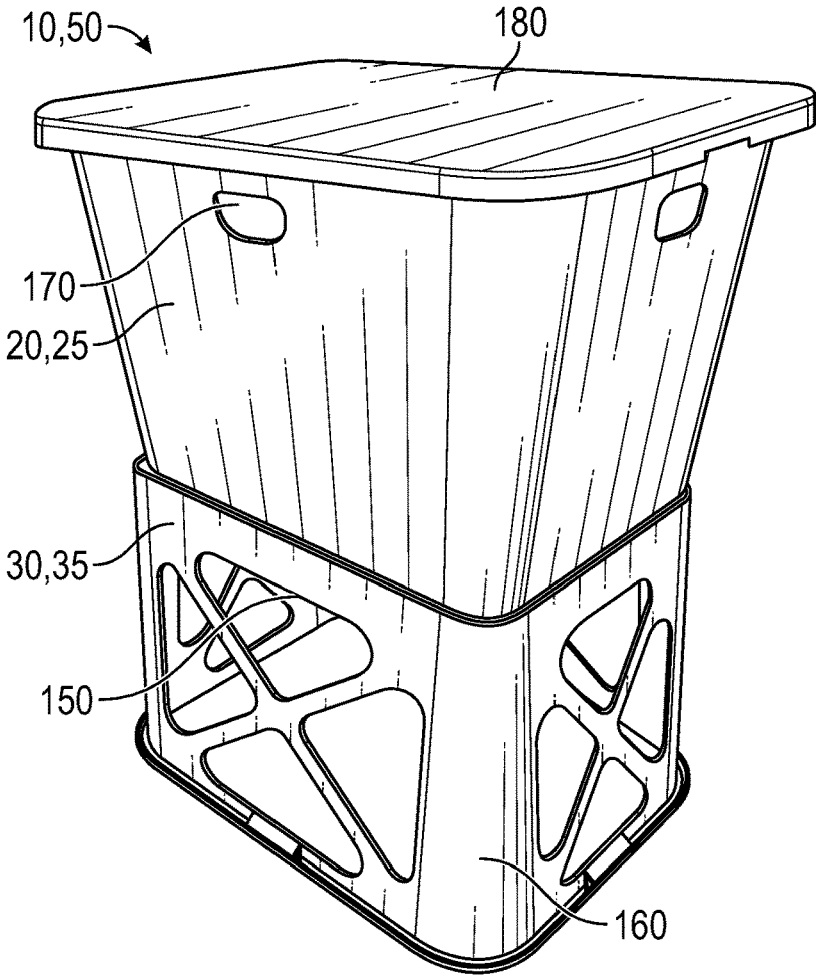
FIG. 2A is a perspective view of an alternate embodiment of the invention, illustrating the container having solid sides and a stand in the stacked configuration.
Figure 2B:
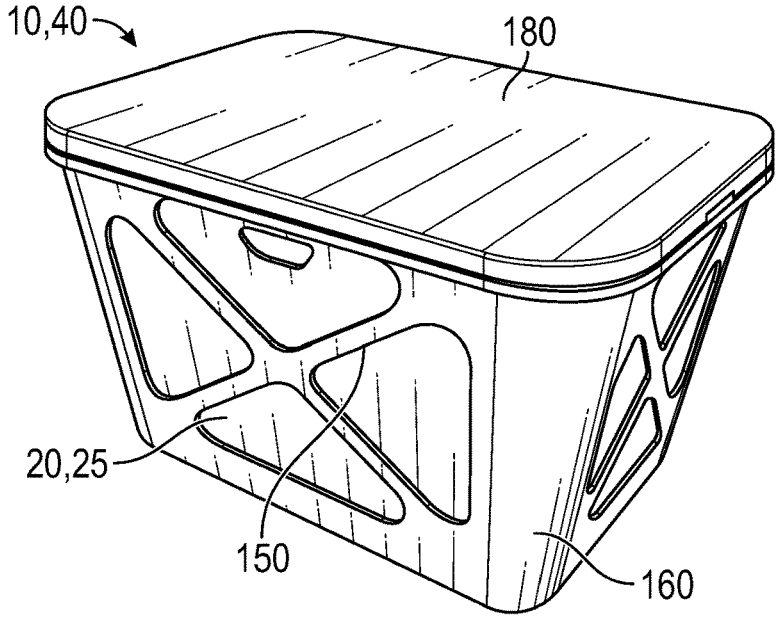
FIG. 2B is a perspective view of the embodiment of FIG. 2A, illustrating the container and the stand in the nested configuration, and further including a top cover for the container.
Figure 3A:
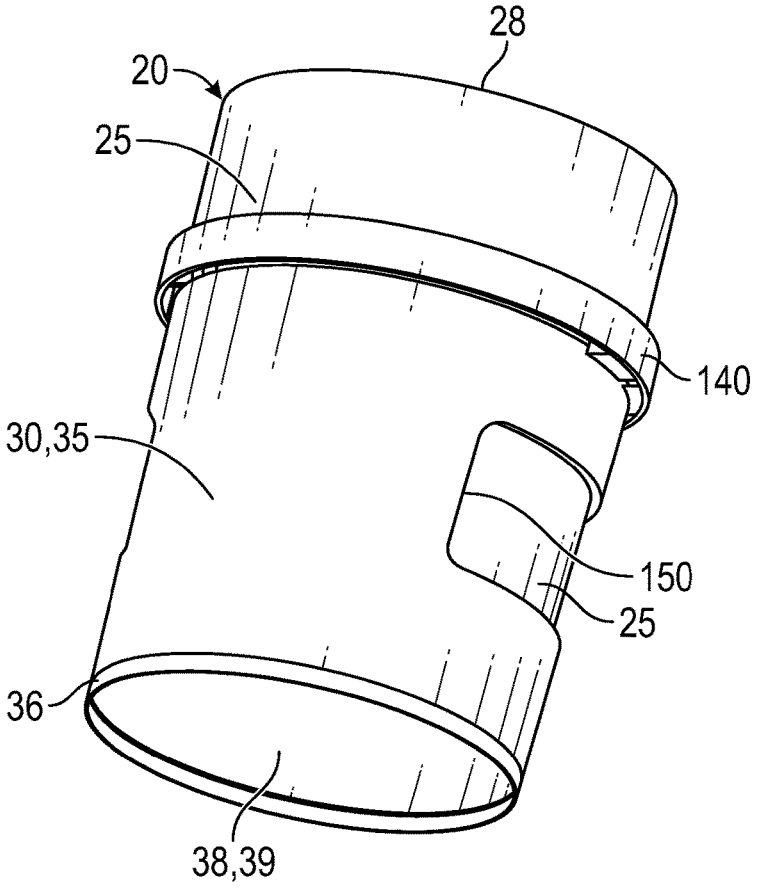
FIG. 3A is a bottom perspective view of an alternate embodiment of the invention, illustrating a cylindrical container and a cooperative cylindrical stand.
Figure 3B:
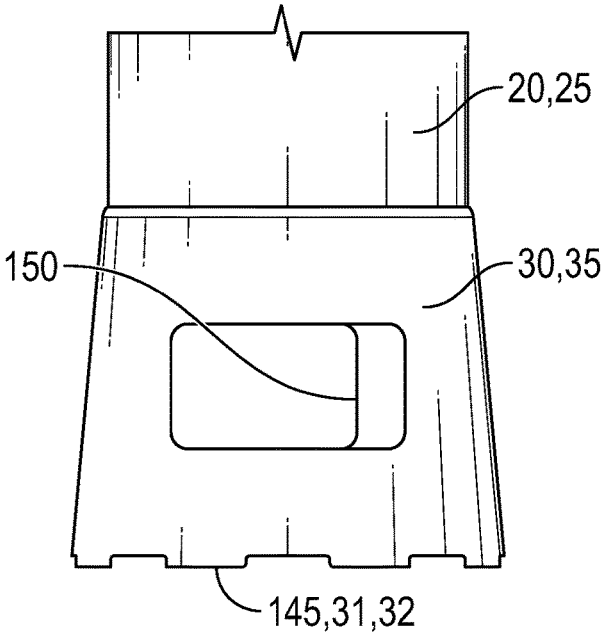
FIG. 3B is a side elevational view of the embodiment of FIG. 3A, illustrating the container and the stand in the stacked configuration with the stand having handle recesses to engage handles of the container.
Figure 3C:
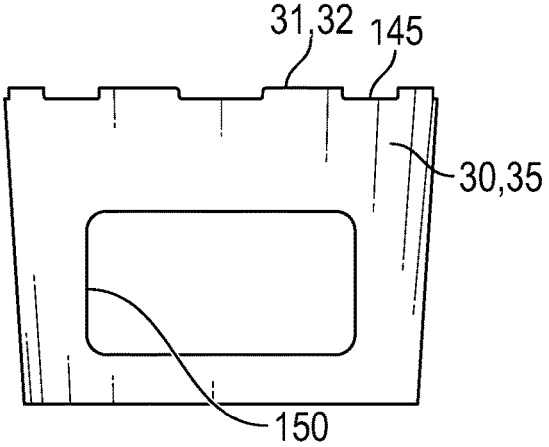
FIG. 3C is an enlarged side elevational view of the bottom end of the container of the embodiment of FIG. 3A.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1A-3C illustrate a container system 10 for use on a horizontal surface 15, such as a floor or ground surface. The container system 10 includes a container 20 that has a bottom 22, at least one peripheral side 25, and an open top end 28. The bottom 22 includes a perimeter 24, a top surface 23, and a bottom surface 21. The at least one peripheral side 25 projects upwardly from the perimeter 24 of the bottom 22 and terminates at a top edge 29. The container 20 is preferably made from an injection molded or rotationally molded plastic material, and can take the form of a basket, bin, barrel, bucket, can, pail, canister, or the like.

A stand 30 has a top 38, at least one peripheral side 35, and an open bottom end 32. The top 38 has a perimeter 36, a top surface 39, and a bottom surface 37. The at least one peripheral side 35 projects downwardly from the perimeter 36 of the top 38 and terminates at a bottom edge 31. The stand 30 is preferably made from an injection molded or rotationally molded plastic material.

The open bottom end 32 of the stand 30, when the stand 30 is inverted, is adapted to receive the bottom 22 and the at least one peripheral side 25 of the container 20 therein such that the container 20 and the stand 30 are configured in a nested configuration 40. Further, the top 38 of the stand 30 is adapted to receive therein the bottom 22 of the container 20 such that the container 20 and the stand 30 are configured in a stacked configuration 50.

In some embodiments, the top surface 39 of the top 38 of the stand 30 includes a raised lip 60 at the perimeter 36 thereof, adapted to receive the bottom 22 of the container 20. As such, the container 20 is inhibited from sliding off of the top 38 of the stand 30 when the container 20 and stand 30 are in the stacked configuration 50.

In preferred embodiments, the open top end 28 of the container 20 includes a curled lip 70 configured for covering at least a portion of the bottom edge 31 of the stand 30 when the container 20 and the stand 30 are in the nested configuration 40. Preferably the bottom edge 31 of the stand 30 includes an outwardly projecting lip 130.

In some embodiments, the bottom edge 31 of the stand 30 includes a plurality of feet 120 adapted to contact the horizontal surface 15 when the stand 30 and the container 20 are in the stacked configuration 50 with the stand 30 resting on the horizontal surface 15. The top edge 29 of the container 20 is configured for substantially encompassing at least the plurality of feet 120 of the stand 30 when the container 20 and the stand 30 are in the nested configuration 40 to prevent dirt or other material that was on the horizontal surface 15 from spreading to other areas of the container system 10. As such, the container system 10 remains more sanitary even if the plurality of feet 120 contact significant grime.

In some embodiments, the container 20 and the stand 30 are both substantially cylindrical in shape, the at least one peripheral side 25 of the container 20 being exactly one peripheral side 25, and the at least one peripheral side 3 of the stand 30 being exactly one peripheral side 35. In such an embedment, the container 20 includes at least one handle 140 fixed with the at least one peripheral side 25 of the container 20. The at least one handle 140 is configured for carrying the container 20 by the at least one handle 140. As such, the bottom edge 31 of the stand 30 includes a plurality of handle recesses 145 for receiving the at least one at least one handle 140 therein when the container 20 and the stand 30 are in the nested configuration. The rotational orientation of the container 20 to the stand 30 does not require careful alignment, in such embodiments, facilitating moving the container system 10 from the stacked configuration 50 to the nested configuration 40.

Figure 6:
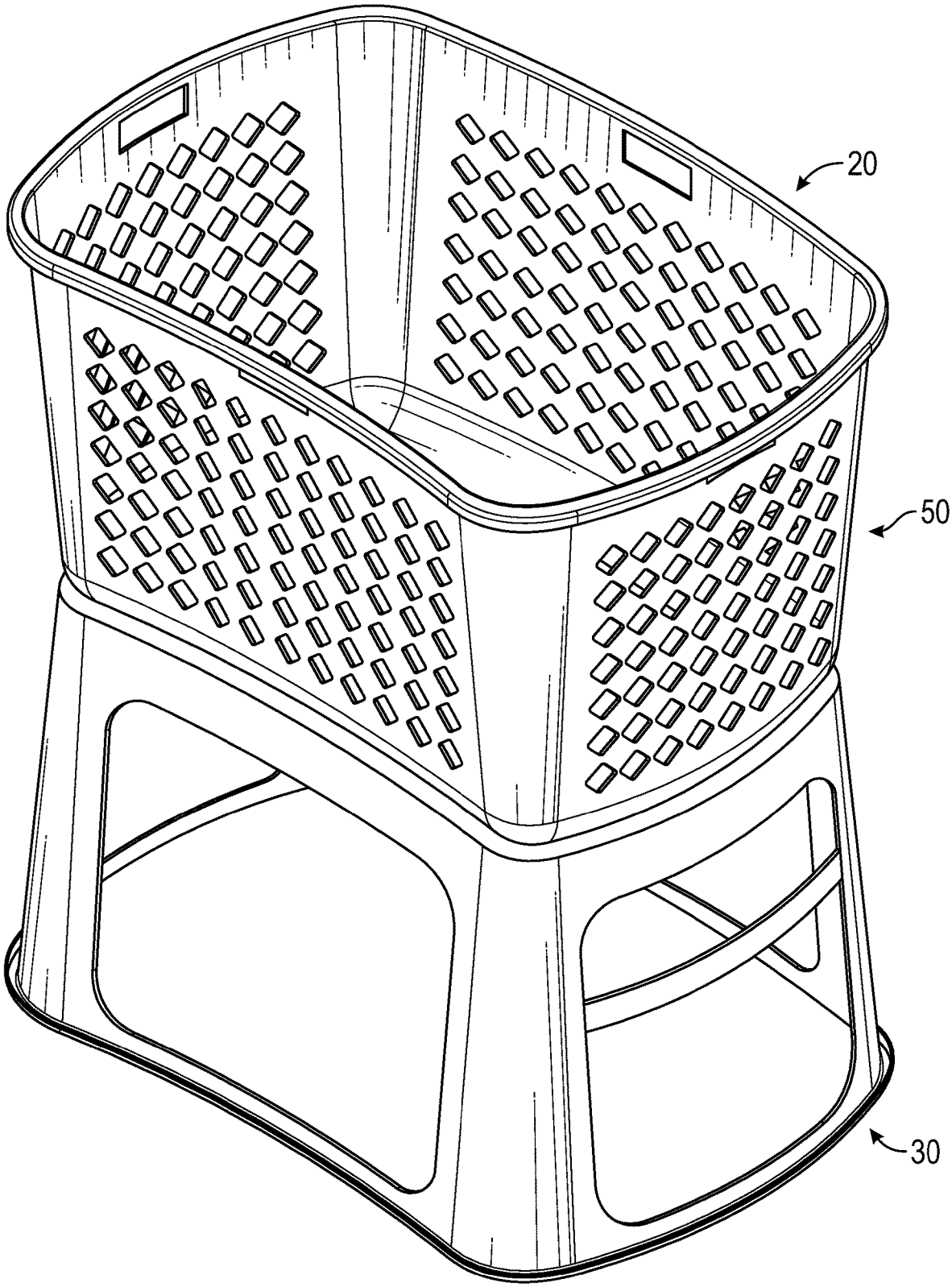
FIG. 6 is a perspective view of a kidney-bean shaped stand and container.

In such cylindrical embodiments, the container 20 includes at least one handle 140 fixed with the at least one peripheral side 25 of the container 20. The at least one handle 140 is configured for carrying the container 20 by the at least one handle 140, and wherein the bottom edge 31 of the stand 30 includes a plurality of handle recesses 145 for receiving the at least one at least one handle 140 therein when the container 20 and the stand 30 are in the nested configuration 40. In other embodiments, the container 20 and the stand 30 are both substantially oval (not shown) or kidney bean shaped (FIG. 6) in plan view.

Figure 4:
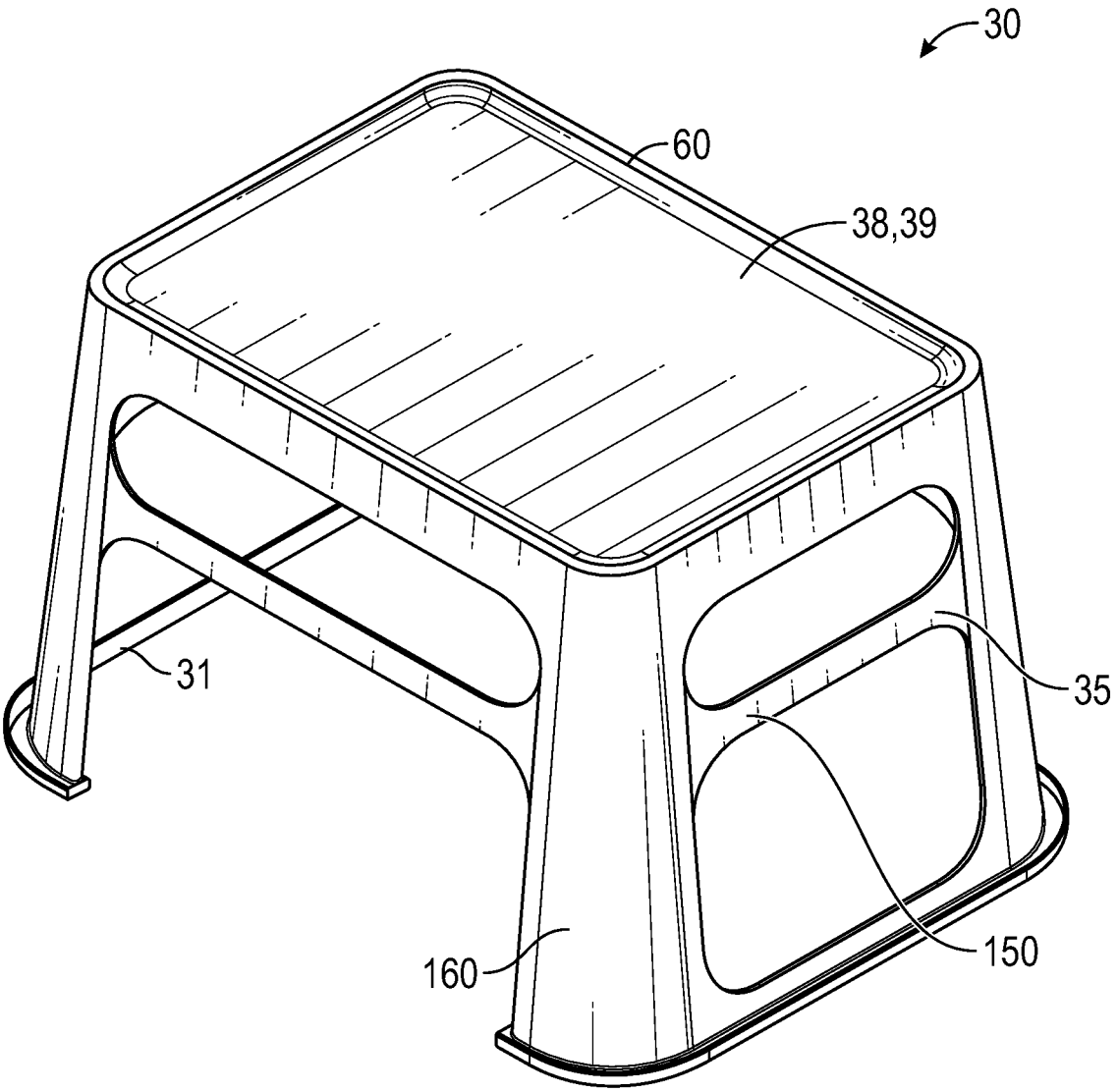
FIG. 4 is a top perspective view of one embodiment of the stand, showing a raised lip at the top surface of the stand.
Figure 5:
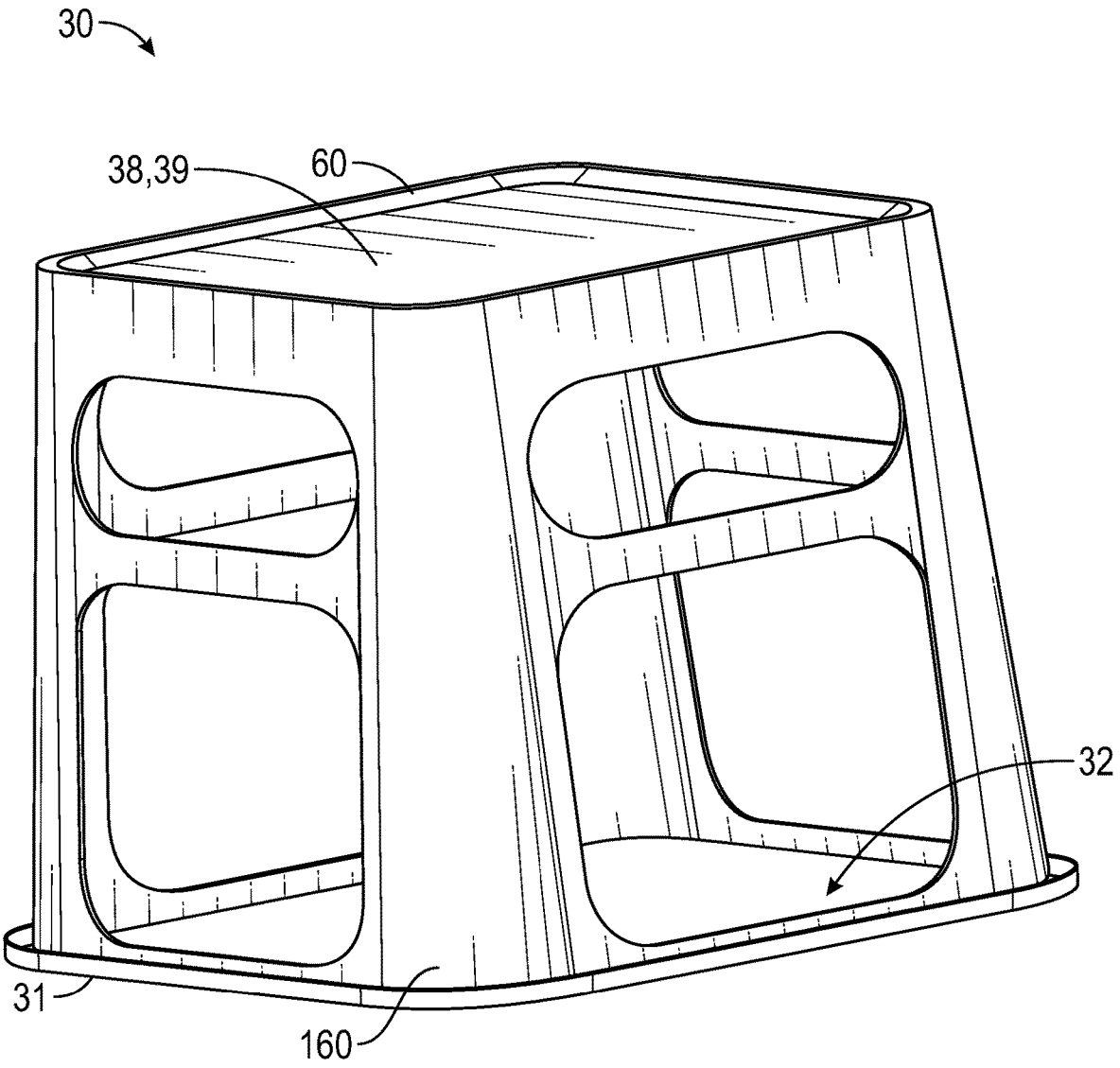
FIG. 5 is a perspective view of a stand having a substantially square top surface.

Alternately, the container 20 and the stand 30 may both be substantially rectangular (FIGS. 1A and 4) or square (FIG. 5) in shape. As such, the at least one peripheral side 25 of the container 20 is exactly four peripheral sides 25, and the at least one peripheral side 35 of the stand 30 is exactly four peripheral sides 35. In the embodiment wherein the container 20 and the stand 30 are substantially square in shape in plan view, the container 20 is insertable into the stand 30 at any angle evenly divisible by 90, making it more convenient to use in some situations.

In such an embodiment, the four peripheral sides 25,35 of both the container 20 and the stand 30 may further include a plurality of apertures 150 (FIG. 4) and four rounded and thickened corners 160, reinforced to support a greater weight in the container 20 when the container 20 and the stand 30 are in either the nested configuration 40 or the stacked configuration 50. Alternately, the four peripheral sides 25 of the container 20 may be solid but for a plurality of handle apertures 170 therethrough (FIGS. 2A-2B), such that the container 20 can operate as a bucket 20 and hold liquid, for example. In such embodiments, air holes can be included in the stand 30 to prevent vacuum locking between the container 20 and the stand 30. Further, a top cover 180 may be included to cover the open top end 28 of the container 20 in such an embodiment.

Alternately, the container 20 and the stand 30 may both be substantially triangular in shape in plan view (not shown). As such, the at least one peripheral side 25 of the container 20 is exactly three peripheral sides 25, and the at least one peripheral side 35 of the stand 30 is exactly three peripheral sides 35. In the embodiment wherein the container 20 and the stand 30 are substantially in the shape of a regular triangle in plan view, the container 20 is insertable into the stand 30 at any angle evenly divisible by 120, making it more convenient to use in some situations.

Alternately, the container 20 and the stand 30 may both be substantially hexagonal in plan view (not shown) As such, the at least one peripheral side 25 of the container 20 is exactly six peripheral sides 25, and the at least one peripheral side 35 of the stand 30 is exactly six peripheral sides 35. In such an embodiment, the container 20 is insertable into the stand 30 at any angle evenly divisible by 60, making it more convenient to use in some situations.

In some embodiments, the container 20 has a height $H_1$ substantially the same as a height $H_2$ of the stand 30. In alternate embodiments the height $H_1$ of the container 20 is less than the height $H_2$ of the stand 30. Further, the container 20 may be tapered from the open top end 28 to the bottom 22, with the stand 30 also being cooperatively tapered from the open bottom end 32 to the top 38. The shape of the container 20 in plan view may be different at the open top end 28 than at the bottom 22. For example, the shape of the container 20 in plan view at the open top end 28 may be a square that transitions to a circle at the bottom 22. In such an embodiment, the stand 30 is cooperatively shaped.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A container system for use on a horizontal surface, comprising:

a container having a bottom, at least one peripheral side, and an open top end, the bottom having a perimeter, a top surface, and a bottom surface, the at least one peripheral side projecting upwardly from the perimeter of the bottom and terminating at a top edge, the at least one peripheral side including a plurality of handle apertures therethrough, the plurality of handle apertures being disposed closer to the open top end of the container than to the bottom of the container; and a stand having a top, at least one peripheral side, and an open bottom end, the top having a perimeter, a top surface, and a bottom surface, the at least one peripheral side of the stand projecting downwardly from the perimeter of the top and terminating at a bottom edge, the at least one peripheral side of the stand including a plurality of apertures therethrough;

wherein the open bottom end of the stand, when the stand is inverted, is adapted to receive the bottom and the at least one peripheral side of the container therein such that the container and the stand are configured in a nested configuration;

wherein the top of the stand is adapted to receive thereon the bottom of the container such that the container and the stand are configured in a stacked configuration; and wherein an entirety of the plurality of handle apertures of the container is fully exposed and accessible through the plurality of apertures of the stand when the container and the stand are in the nested configuration.

2. The container system of claim 1 wherein the top surface of the top of the stand includes a raised lip at the perimeter thereof adapted to receive the bottom of the container, whereby the container is inhibited from sliding off of the top of the stand.

3. The container system of claim 1 wherein the open top end of the container includes a curled lip configured for covering at least a portion of the bottom edge of the stand when the container and the stand are in the nested configuration.

4. The container system of claim 1 wherein the bottom edge of the stand includes a plurality of feet adapted to contact the horizontal surface when the stand and container are in the stacked configuration with the stand resting on the horizontal surface, the top edge of the container configured for substantially encompassing at least the plurality of feet of the stand when the container and the stand are in the nested configuration.

5. The container system of claim 1 wherein the bottom edge of the stand includes an outwardly projecting lip.

6. The container system of claim 1 wherein the container and the stand are both substantially rectangular in shape, the at least one peripheral side of the container being exactly four peripheral sides, and the at least one peripheral side of the stand being exactly four peripheral sides.

7. The container system of claim 6 wherein the four peripheral sides of the container include a plurality of apertures therethrough, and the four peripheral sides of the stand include the plurality of apertures of the stand therethrough.

8. The container system of claim 7 wherein each of the four peripheral sides of the stand meet at four rounded and thickened corners.

9. The container system of claim 1 wherein the at least one peripheral side of the container is solid but for the plurality of handle apertures therethrough.

10. The container system of claim 1 wherein the container has a height substantially the same as a height of the stand.

11. The container system of claim 1 wherein the container has a height of less than a height of the stand.

12. The container system of claim 1 wherein the container and the stand are both substantially square in shape, the at least one peripheral side of the container being exactly four peripheral sides, and the at least one peripheral side of the stand being exactly four peripheral sides, the container being insertable into the stand at any angle evenly divisible by 90.

13. The container system of claim 1 wherein the container is tapered from the open top end to the bottom, and wherein the stand is cooperatively tapered from the open bottom end to the top.

14. A container system for use on a horizontal surface, comprising:

a container having a bottom, at least one peripheral side, and an open top end, the bottom having a perimeter, a top surface, and a bottom surface, the at least one peripheral side projecting upwardly from the perimeter of the bottom and terminating at a top edge, the container further having at least one handle fixed with the at least one peripheral side; and a stand having a top, at least one peripheral side, and an open bottom end, the top having a perimeter, a top surface, and a bottom surface, the at least one peripheral side of the stand projecting downwardly from the perimeter of the top and terminating at a bottom edge, the bottom edge including a plurality of handle recesses;

wherein the container and the stand are not identical with respect to one another;

wherein the open bottom end of the stand, when the stand is inverted, is adapted to receive the bottom and the at least one peripheral side of the container therein such that the container and the stand are configured in a nested configuration;

wherein the top of the stand is adapted to receive thereon the bottom of the container such that the container and the stand are configured in a stacked configuration;

wherein the plurality of handle recesses of the stand receives the at least one handle of the container therein when the container and the stand are in the nested configuration; and wherein, when the container and the stand are in an upright orientation in the nested configuration, the at least one handle of the container extends laterally outward beyond the plurality of handle recesses of the stand and laterally outward beyond the bottom edge of the stand such that an outermost side of the at least one handle of the container is disposed outboard of the bottom edge of the stand.

15. The container system of claim 14 wherein the container and the stand are both substantially cylindrical in shape, the at least one peripheral side of the container being exactly one peripheral side, and the at least one peripheral side of the stand being exactly one peripheral side.

* * * * *